US011774101B2

(12) United States Patent
Tokuyama et al.

(10) Patent No.: US 11,774,101 B2
(45) Date of Patent: Oct. 3, 2023

(54) COMBUSTION TUBE AND COMBUSTOR FOR GAS TURBINE, AND GAS TURBINE

(71) Applicant: MITSUBISHI HEAVY INDUSTRIES, LTD., Tokyo (JP)

(72) Inventors: Kentaro Tokuyama, Yokohama (JP); Kenji Sato, Yokohama (JP); Kenta Taniguchi, Yokohama (JP); Hiroyuki Sakaki, Yokohama (JP); Takashi Hiyama, Tokyo (JP); Satoshi Takiguchi, Tokyo (JP); Yusuke Tanaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/983,675

(22) Filed: Nov. 9, 2022

(65) Prior Publication Data

US 2023/0061373 A1 Mar. 2, 2023

Related U.S. Application Data

(62) Division of application No. 16/648,735, filed as application No. PCT/JP2018/038770 on Oct. 18, 2018, now abandoned.

(30) Foreign Application Priority Data

Nov. 20, 2017 (JP) ..... 2017-223156

(51) Int. Cl.
*F23R 3/50* (2006.01)

(52) U.S. Cl.
CPC ..... *F23R 3/50* (2013.01)

(58) Field of Classification Search
CPC .... F01D 9/023; F23R 3/50; F23R 3/16; F23R 3/42; F23R 3/46; F23R 3/002; F05D 2240/35
See application file for complete search history.

(56) References Cited

U.S. PATENT DOCUMENTS 4,195,474 A 4/1980 Bintz et al.
7,757,492 B2 7/2010 Intile et al.
(Continued)

FOREIGN PATENT DOCUMENTS

CN 1497217 5/2004
CN 101776013 7/2010
(Continued)

OTHER PUBLICATIONS

International Search Report dated Jan. 8, 2019 in International (PCT) Patent Application No. PCT/JP2018/038770, with English Translation.
(Continued)

*Primary Examiner* — Jason H Duger
(74) *Attorney, Agent, or Firm* — Wenderoth, Lind & Ponack, L.L.P.

(57) ABSTRACT

A combustion tube for a gas turbine including an outlet section having a cross-section of an annular sector-shape. The outlet section includes an outer wall forming an outer peripheral boundary of the annular sector-shape, an inner wall forming an inner peripheral boundary of the annular sector-shape, and a pair of side walls forming boundaries on both sides of the annular sector-shape in a circumferential direction, respectively. The outer wall extends obliquely with respect to the inner wall such that a height of the annular sector-shape decreases toward an outlet opening of the combustion tube. A first side wall extends obliquely with respect to a second side such that a perimeter of the annular sector-shape increases toward the outlet opening of the combustion tube. An inclination angle $\theta_1$ of the first side wall with respect to the second side wall satisfies $0<\theta_1\leq 56$.

6 Claims, 10 Drawing Sheets

(56) References Cited

U.S. PATENT DOCUMENTS

| | | | | |
|---|---|---|---|---|
| 2004/0060298 | A1* | 4/2004 | Han | F01D 9/02 60/725 |
| 2008/0202124 | A1* | 8/2008 | Sutcu | F01D 9/023 60/796 |
| 2010/0037619 | A1 | 2/2010 | Charron | |
| 2010/0170259 | A1 | 7/2010 | Huffman | |
| 2010/0248171 | A1 | 9/2010 | Hayashi et al. | |
| 2011/0265491 | A1 | 11/2011 | Nakamura et al. | |
| 2012/0177487 | A1 | 7/2012 | Headland et al. | |
| 2013/0074502 | A1 | 3/2013 | Hada et al. | |
| 2014/0260272 | A1 | 9/2014 | DiCintio et al. | |
| 2014/0260273 | A1 | 9/2014 | Melton et al. | |

FOREIGN PATENT DOCUMENTS

| | | |
|---|---|---|
| CN | 103764974 | 4/2014 |
| DE | 10 2014 103 022 | 9/2014 |
| JP | 54-71216 | 6/1979 |
| JP | 63-143422 | 6/1988 |
| JP | 10-82527 | 3/1998 |
| JP | 2000-130759 | 5/2000 |
| JP | 2001-349544 | 12/2001 |
| JP | 2010-84704 | 4/2010 |
| JP | 2010/159753 | 7/2010 |
| JP | 2013-72316 | 4/2013 |
| JP | 2014-181902 | 9/2014 |
| JP | 2014-181906 | 9/2014 |

OTHER PUBLICATIONS

International Preliminary Report on Patentability dated Jun. 4, 2020 in International (PCT) Patent Application No. PCT/JP2018/038770.

Notice of Reasons for Refusal dated Jan. 5, 2018 in Japanese Patent Application No. 2017-223156, with Machine Translation.

The Office Action dated Apr. 22, 2021, issued in counterpart DE application No. 112018004526.9.

Office Action dated Nov. 25, 2020 in corresponding CN application No. 201880060956.7.

Saito et al., Machine Translation to English of JP-2001349544-A, 2001, Retrieved From Espacenet.com Sep. 14, 2022 (Year: 2001).

* cited by examiner

COMBUSTION TUBE AND COMBUSTOR FOR GAS TURBINE, AND GAS TURBINE

TECHNICAL FIELD

The present disclosure relates to a combustion tube and a combustor for a gas turbine, and the gas turbine.

BACKGROUND

A gas turbine generally includes a plurality of combustors disposed in the circumferential direction. Each of the combustors includes a combustion tube through which a high-temperature combustion gas passes. The combustion gas is generated in each of the combustors and heads for a turbine. The combustion tube generally has a circular cross-sectional shape in an inlet part and has an annular sector cross-sectional shape in an outlet part. The outlet part of the combustion tube and an inlet part of the turbine are connected in a state in which a gap between the combustion tube and an adjacent combustor is reduced.

As such a combustion tube, for example, Patent Document 1 discloses a combustion liner which includes a conical section positioned on an inlet side of the combustion liner (combustion tube) and having a circular cross-section, and a transition section positioned on an outlet side of the combustion liner and having a non-circular cross-section. The transition section has a nearly circular cross-sectional shape on an upstream side to which the conical section is connected and has a nearly rectangular cross-sectional shape (that is, the annular sector cross-sectional shape) on an outlet opening side (downstream) of the combustion liner, between which the cross-sectional shape changes gradually.

CITATION LIST

Patent Literature

Patent Document 1: JP2014-181906A

SUMMARY

Technical Problem

As the combustion liner (combustion tube) described in Patent Document 1, if the combustion tube has a cross-sectional shape which gradually changes from the circular shape to the annular sector-shape in the outlet part thereof, a flow path cross-sectional area of the combustion tube may increase halfway. In this case, in the combustion tube, flow separation is likely to occur in a place where the flow path cross-sectional area increases. The flow separation may become a factor of a pressure loss in a gas turbine. Therefore, in the combustion tube, it is desirable to suppress the expansion of the flow path cross-sectional area in the middle of a combustion gas passage. However, Patent Document 1 does not disclose any specific measure for suppressing the expansion of the flow path cross-sectional area of the combustion tube.

In view of the above, an object of at least one embodiment of the present invention is to provide a combustion tube and a combustor for a gas turbine, and the gas turbine capable of suppressing flow separation in the combustion tube.

Solution to Problem (1) A combustion tube for a gas turbine according to at least one embodiment of the present invention is a combustion tube for a gas turbine including an outlet section having a cross-section of an annular sector-shape. The outlet section includes an outer wall forming an outer peripheral boundary of the annular sector-shape, an inner wall forming an inner peripheral boundary of the annular sector-shape, and a pair of side walls forming boundaries on both sides of the annular sector-shape in a circumferential direction, respectively. The outer wall extends obliquely with respect to the inner wall such that a height of the annular sector-shape decreases toward an outlet opening of the combustion tube. A first side wall of the pair of side walls extends obliquely with respect to a second side wall of the pair of side walls such that a perimeter of the annular sector-shape increases toward the outlet opening of the combustion tube. An inclination angle $\theta_1$ [deg] of the first side wall with respect to the second side wall satisfies $0<\theta_1\leq 56$.

With the above configuration (1), it is possible to suppress flow separation in the combustion tube through appropriate distribution of a flow path cross-sectional area in an outlet part including the outlet section of the combustion tube by setting the above-described inclination angle $\theta_1$ greater than zero and not greater than 56 degrees. Thus, it is possible to reduce a pressure loss in the gas turbine.

(2) In some embodiments, in the above configuration (1), an inclination angle $\theta_2$ [deg] of the outer wall with respect to the inner wall satisfies $11\leq\theta_2\leq 25$.

With the above configuration (2), setting, the inclination angle $\theta_2$ [deg] within the range of $11\leq\theta_2\leq 25$ in combination with the above-described inclination angle $\theta_1$ set not greater than 56 degrees, it is possible to further suppress the flow separation in the combustion tube. Thus, it is possible to effectively reduce the pressure loss in the gas turbine.

(3) In some embodiments, in the above configuration (1) or (2), the inclination angle $\theta_1$ satisfies $12\leq\theta_1\leq 56$.

With the above configuration (3), setting the above-described inclination angle $\theta_1$ not less than 12 degrees, it is possible to reduce the length of the combustion tube needed to increase the perimeter of the annular sector-shape in the outlet section to the perimeter of the outlet opening and to reduce the size of the combustion tube.

(4) In some embodiments, in any one of the above configurations (1) to (3), the inclination angle $\theta_1$ satisfies $0<\theta_1\leq 40$.

(5) In some embodiments, in the above configuration (4), the inclination angle $\theta_1$ satisfies $0<\theta_1\leq 30$.

With the above configuration (4) or (5), setting an upper limit value of the inclination angle $\theta_1$ at 40 degrees or not greater than 30 degrees in combination with the above-described inclination angle $\theta_1$ set not greater than 56 degrees, it is possible to further suppress the flow separation in the combustion tube.

(6) A combustion tube of a gas turbine according to at least one embodiment of the present invention is a combustion tube for a gas turbine including an outlet section having a cross-section of an annular sector-shape. The outlet section includes an outer wall forming an outer peripheral boundary of the annular sector-shape, an inner wall forming an inner peripheral boundary of the annular sector-shape, and a pair of side walls forming boundaries on both sides of the annular sector-shape in a circumferential direction, respectively. The outer wall extends obliquely with respect to the inner wall such that a height of the annular sector-shape decreases toward an outlet opening of the combustion tube. A first side wall of the pair of side walls extends obliquely with respect to a second side wall of the pair of side walls such that a perimeter of the annular sector-shape increases toward the outlet opening of the combustion tube. $|\theta_1|<|\theta_2|\times(Am_1/H_1)$ is satisfied, where $\theta_1$ [deg] is an inclination angle of the first side wall with respect to the second side wall, $\theta_2$ [deg] is an inclination angle of the outer wall with respect to the inner wall, $H_1$ is a height of the annular sector-shape at a downstream end of the outlet section, and $Am_1$ is an average perimeter of the outer wall and the inner wall.

According to findings of the present inventors, in order for the flow path cross-sectional area of the outlet section to gradually decrease downward, the above-described inclination angles $\theta_1$ and $\theta_2$, the height $H_1$ of the annular sector-shape at the downstream end 62*b* of the outlet section, and the average perimeter $Am_1$ of the outer wall and the inner wall of the annular sector-shape need to satisfy $|\theta_1|<|\theta_2|\times(Am_1/H_1)$.

In this regard, with the above configuration (6), since the above-described $\theta_1$, $\theta_2$, $H_1$, and $Am_1$ satisfy $|\theta_1|<|\theta_2|\times(Am_1/H_1)$, the flow path cross-sectional area in the outlet part including the outlet section of the combustion tube decreases downward. Thus, with the above configuration (6), it is possible to suppress the flow separation in the combustion tube and to effectively reduce the pressure loss in the gas turbine.

(7) In some embodiments, in any one of the above configurations (1) to (6), the combustion tube for the gas turbine includes an inlet section having an circular cross-section and forming an inlet opening of the combustion tube, and an intermediate section positioned between the inlet section and the outlet section, and having a cross-sectional shape which changes from the circular cross-section of the inlet section to the cross-section of the annular sector-shape of the outlet section along a longitudinal direction of the combustion tube.

With the above configuration (7), it is possible to suppress the flow separation in the combustion tube which includes the inlet section, the outlet section, and the intermediate section positioned between the inlet section and the outlet section, and to reduce the pressure loss in the gas turbine.

(8) In some embodiments, in the above configuration (7), the outer wall of the outlet section extends obliquely with respect to a center line of the inlet section such that a distance between the outer wall and the center line increases toward the outlet opening of the combustion tube.

With the above configuration (8), it is possible to suppress the pressure loss by smoothly connecting the outer wall of the outlet section in the combustion tube and the outer shroud of the first-stage stator vane while setting the inclination angle of the center line of the inlet section in the combustion tube with respect to the axial direction of the gas turbine large to reduce the size of the combustion tube in the axial direction.

(9) In some embodiments, in the above configuration (7) or (8), the intermediate section includes a first wall portion connected to the outer wall of the outlet section, and a second wall portion connected to the inner wall of the outlet section, the first wall portion of the intermediate section includes, in a cross-section along the longitudinal direction of the combustion tube, a first curved convex portion having a curvature radius of $R_{out1}$ and having a curvature center on a side of an interior space of the combustion tube, and a curved concave portion positioned downstream of the first curved convex portion, and having a curvature radius of $R_{in1}$ and having a curvature center on a side opposite to the interior space of the combustion tube across the first wall portion, the second wall portion of the intermediate section includes, in the cross-section along the longitudinal direction of the combustion tube, a second curved convex portion having a curvature radius of $R_{out2}$ and having a curvature center on the side of the interior space of the combustion tube, and $R_{out1}<R_{in1}<R_{out2}$ is satisfied.

With the above configuration (9), the cross-sectional shape of the combustion tube is rapidly changed from a cylindrical shape of the inlet section toward the annular sector-shape of the outlet section by setting the curvature radius $R_{out1}$ smallest among the above-described curvature radii $R_{out1}$, $R_{in1}$, and $R_{out2}$, making it possible to reduce the length of the intermediate section. Moreover, the curvature of the curved concave portion of the first wall portion in the intermediate section is relatively decreased by setting $R_{out1}<R_{in1}$, making it possible to increase the intermediate section $\theta_2$ of the outer wall in the outlet section and to suppress the flow separation in the outlet section. Furthermore, the shape of the second wall portion in the intermediate section is changed slowly by setting the curvature radius $R_{out2}$ largest among the above-described three types of curvature radii, making it possible to suppress the pressure loss.

(10) In some embodiments, in any one of the above configurations (1) to (9), the outlet section is joined to the intermediate section by welding.

With the above configuration (10), since the outlet section and the intermediate section are joined by welding, it is possible to manufacture the outlet section and the intermediate section as separate components. Thus, it is possible to select shapes and manufacturing methods of the outlet section and the intermediate section flexibly.

In other embodiments, the outlet section and the intermediate section may integrally be formed.

(11) In some embodiments, in the above configuration (10), the outlet section is a cast component.

The outlet section constituting the outlet part of the combustor may be required to have a complicated structure in order to, for example, be connected to the inlet part of the turbine. In this regard, with the above configuration (11), since the outlet section is formed by casting, the outlet section is manufactured easily, even if the outlet section has a relatively complicated structure.

(12) A combustor for a gas turbine according to at least one embodiment of the present invention includes a combustor for a gas turbine, including a burner for combusting a fuel, and the combustion tube according to any one of the above configurations (1) to (11) forming a passage for a combustion gas generated by combustion of the fuel with the burner.

With the above configuration (12), it is possible to suppress the flow separation in the combustion tube through appropriate distribution of the flow path cross-sectional area in the outlet part including the outlet section of the combustion tube by setting the above-described inclination angle $\theta_1$ not greater than 56 degrees. Thus, it is possible to reduce the pressure loss in the gas turbine.

(13) A gas turbine according to at least one embodiment of the present invention includes a gas turbine, including the combustor according to the above configuration (12), and a first-stage stator vane disposed downstream of the combustion tube of the combustor, an angle between an outer shroud of the first-stage stator vane and the outer wall of the outlet section in the combustion tube is not greater than 7 degrees on an axial cross-section for the gas turbine.

With the above configuration (13), it is possible to suppress the flow separation in the combustion tube through appropriate distribution of the flow path cross-sectional area in the outlet part including the outlet section of the combustion tube by setting the above-described inclination angle $\theta_1$ not greater than 56 degrees. Thus, it is possible to reduce the pressure loss in the gas turbine.

Moreover, with the above configuration (13), since the angle between the outer shroud of the first-stage stator vane and the outer wall of the outlet section in the combustion tube is not greater than 7 degrees on the axial cross-section of the gas turbine, the outer shroud of the first-stage stator vane forming the combustion gas passage in the inlet part of the turbine and the outer wall are likely to be connected smoothly. Thus, it is possible to suppress the flow separation in a connection part between the combustion tube and the turbine, and to reduce the pressure loss in the gas turbine more effectively.

Advantageous Effects

According to at least one embodiment of the present invention, a combustion tube and a combustor for a gas turbine, and the gas turbine capable of suppressing flow separation in the combustion tube are provided.

DETAILED DESCRIPTION

Figure 1:
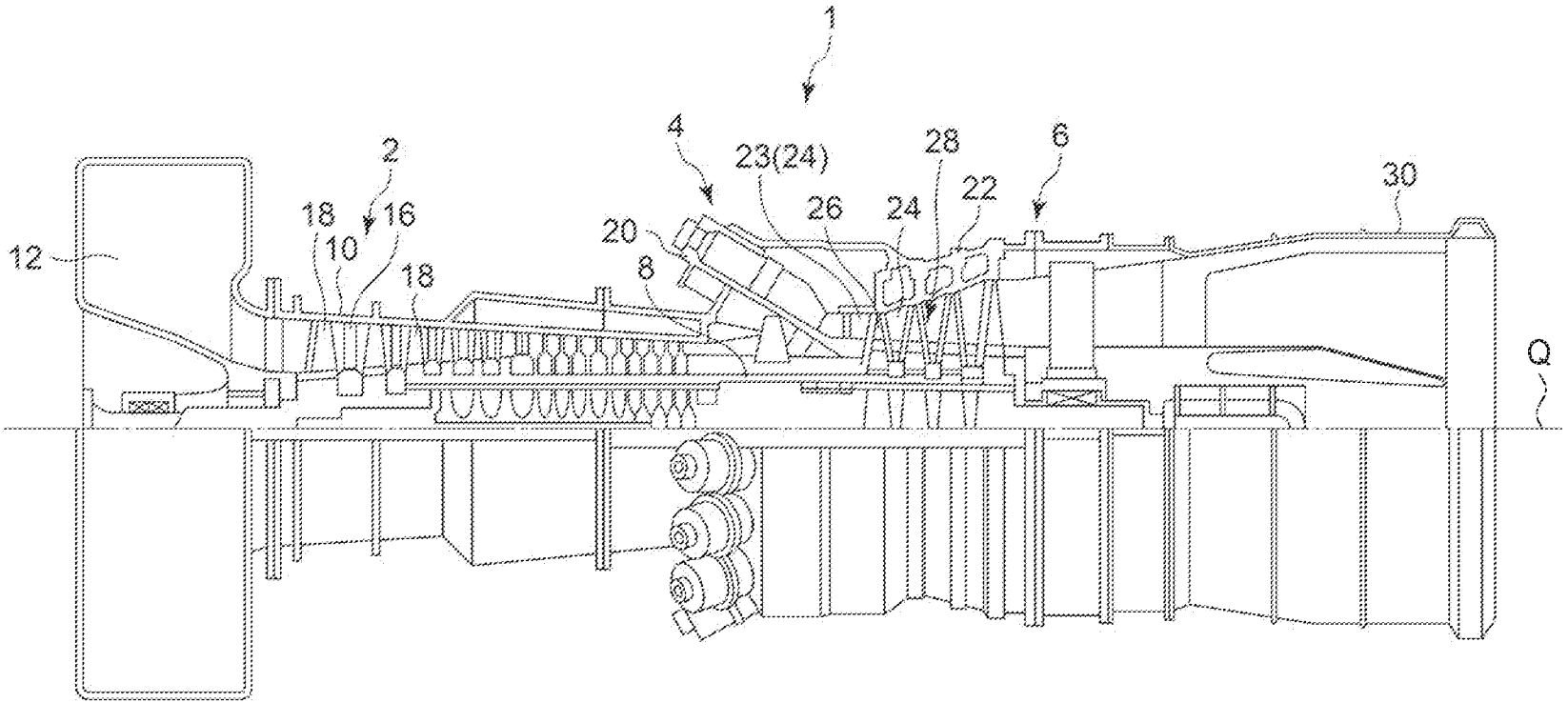
FIG. 1 is a schematic configuration view of a gas turbine according to an embodiment.

Embodiments of the present invention will now be described in detail with reference to the accompanying drawings. It is intended, however, that unless particularly identified, dimensions, materials, shapes, relative positions and the like of components described in the embodiments or shown in the drawings shall be interpreted as illustrative only and not intended to limit the scope of the present invention.

FIG. 1 is a schematic configuration view of a gas turbine according to an embodiment.

As shown in FIG. 1, a gas turbine 1 includes a compressor 2 for generating compressed air, combustors 4 for each generating a combustion gas from the compressed air and a fuel, and a turbine 6 configured to be rotationally driven by the combustion gas. In the case of the gas turbine 1 for power generation, a generator (not shown) is connected to the turbine 6.

The compressor 2 includes a plurality of stator vanes 16 fixed to the side of a compressor casing 10 and a plurality of rotor blades 18 implanted on a rotor 8 so as to be arranged alternately with respect to the stator vanes 16.

Intake air from an air inlet 12 is sent to the compressor 2, and passes through the plurality of stator vanes 16 and the plurality of rotor blades 18 to be compressed, turning into compressed air having a high temperature and a high pressure.

Each of the combustors 4 is supplied with a fuel and the compressed air generated by the compressor 2, and combusts the fuel to generate the combustion gas which serves as a working fluid of the turbine 6. As shown in FIG. 1, the gas turbine 1 includes the plurality of combustors 4 which are arranged in a casing 20 along the circumferential direction centering around the rotor 8.

The turbine 6 includes a combustion gas passage 28 formed by a turbine casing 22, and includes a plurality of stator vanes 24 and rotor blades 26 disposed in the combustion gas passage 28.

Each of the stator vanes 24 is fixed to the side of the turbine casing 22. The plurality of stator vanes 24 arranged along the circumferential direction of the rotor 8 form a stator vane row. Moreover, each of the rotor blades 26 is implanted on the rotor 8. The plurality of rotor blades 26 arranged along the circumferential direction of the rotor 8 form a rotor blade row. The stator vane row and the rotor blade row are alternately arranged in the axial direction of the rotor 8. Of the plurality of stator vanes 24, the stator vane 24 disposed most upstream (that is, the stator vane 24 disposed at a position close to the combustors 4) is a first-stage stator vane 23.

In the turbine 6, the combustion gas flowing into the combustion gas passage 28 from the combustors 4 passes through the plurality of stator vanes 24 and the plurality of rotor blades 26, thereby rotationally driving the rotor 8. Consequently, the generator connected to the rotor 8 is driven to generate power. The combustion gas having driven the turbine 6 is discharged outside via an exhaust chamber 30.

Figure 2:
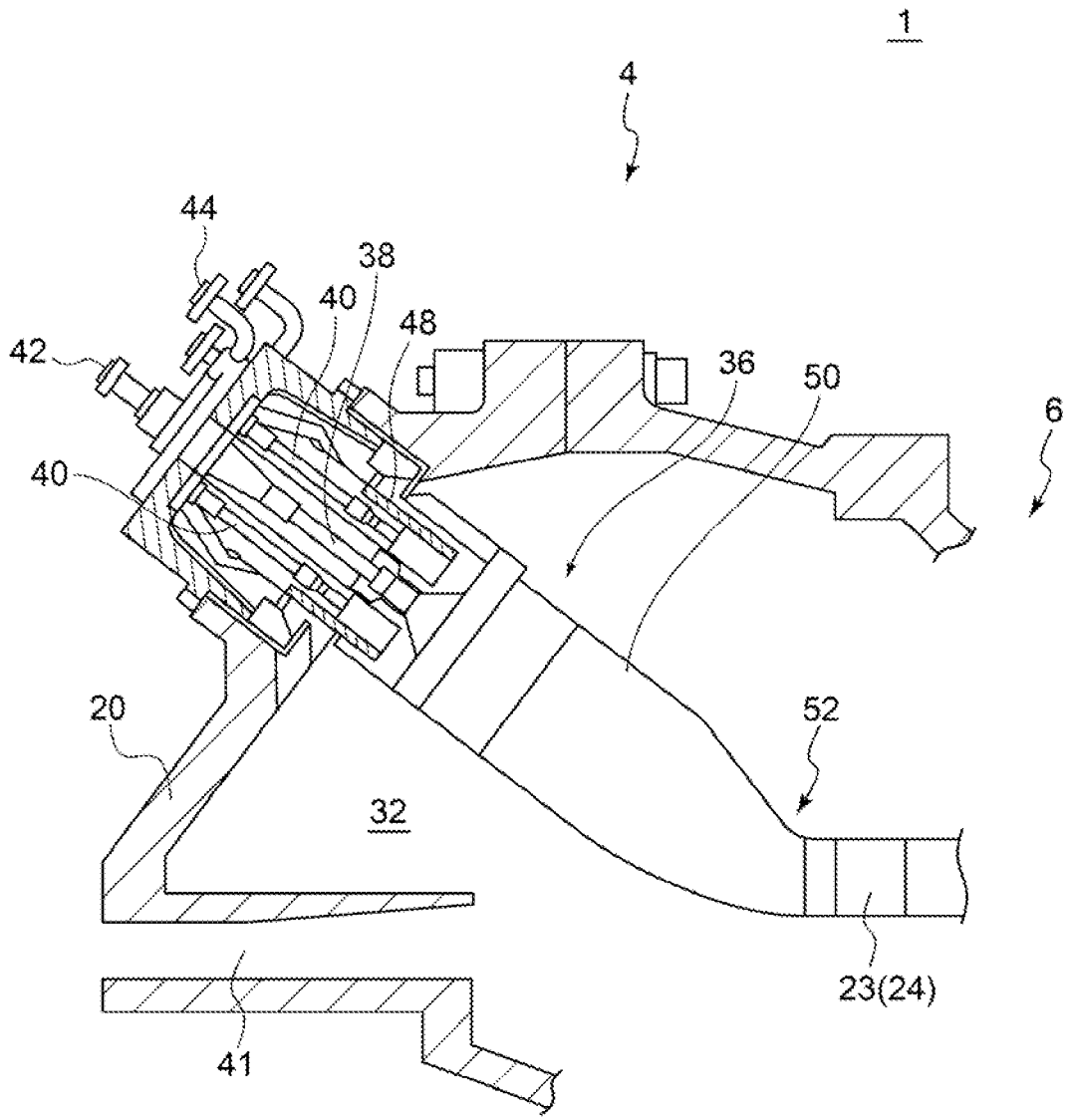
FIG. 2 is a schematic view of a combustor for the gas turbine and an inlet portion of a turbine according to an embodiment.

FIG. 2 is a schematic view of the combustor 4 and an inlet portion of the turbine 6 in the gas turbine 1 according to an embodiment.

As shown in FIG. 2, each of the plurality of combustors 4 which are annularly arranged centering around the rotor 8 (see FIG. 1) includes a combustion tube (combustor liner) 36, and a first combustion burner 38 and a plurality of second combustion burners 40 arranged in the combustor liner 36, respectively. The combustor liner 36 is disposed in a plenum 32 defined by the casing 20. The second combustion burners 40 are arranged so as to surround the first combustion burner 38. That is, in the gas turbine 1, the plurality of combustion tubes 36 of the combustors 4 are circumferentially arranged.

The combustor 4 may include other constituent elements such as a bypass pipe (not shown) for allowing the combustion gas to bypass.

The combustion tube (combustor liner) 36 includes a combustor basket 48 arranged around the first combustion burner 38 and the plurality of second combustion burners 40, and a transition piece 50 connected to a tip part of the combustor basket 48. The combustor basket 48 and the transition piece 50 may form a combustion tube as a single piece.

The first combustion burner 38 and the second combustion burners 40 each include a fuel nozzle (not shown) for injecting a fuel and a burner tube (not shown) arranged so as to surround the fuel nozzle. Each fuel nozzle is supplied with the fuel via fuel ports 42, 44. Moreover, the compressed air generated by the compressor 2 (see FIG. 1) is supplied into the plenum 32 via a casing inlet 41, and then flows into each burner tube from the plenum 32. Then, the fuel injected from the fuel nozzle and the compressed air are mixed in each burner tube, and the air-fuel mixture flows into the combustion liner 36 to be ignited and combusted, thereby generating a combustion gas.

The first combustion burner 38 may be a burner for producing a diffusion combustion flame, and the second combustion burners 40 may be burners for combusting premixed air to produce a premixed combustion flame.

That is, the fuel from the fuel port 44 and the compressed air are premixed in the second combustion burners 40, and the premixed air-fuel mixture mainly forms a swirl flow by a swirler (not shown) and flows into the combustion tube 36. Further, the compressed air and the fuel injected from the first combustion burner 38 via the fuel port 42 are mixed in the combustion tube 36, and ignited by a pilot light (not shown) to be combusted, thereby generating a combustion gas. At this time, a part of the combustion gas diffuses to the surroundings with flames, which ignites the premixed air-fuel mixture flowing into the combustion tube 36 from each of the second combustion burners 40 to cause combustion. Specifically, the diffusion combustion flame due to the diffusion combustion fuel injected from the first combustion burner 38 can hold flames for performing stable combustion of premixed air-fuel mixture (premixed fuel) from the second combustion burners 40. At this time, a combustion region is formed in, for example, the combustor basket 48 and may not be formed in the transition piece 50.

The combustion gas generated by combustion of the fuel in the combustors 4 as described above flows into the first-stage stator vane 23 of the turbine 6 via an outlet part 52 of the combustor 4 positioned at the downstream end of the transition piece 50.

Figure 3:
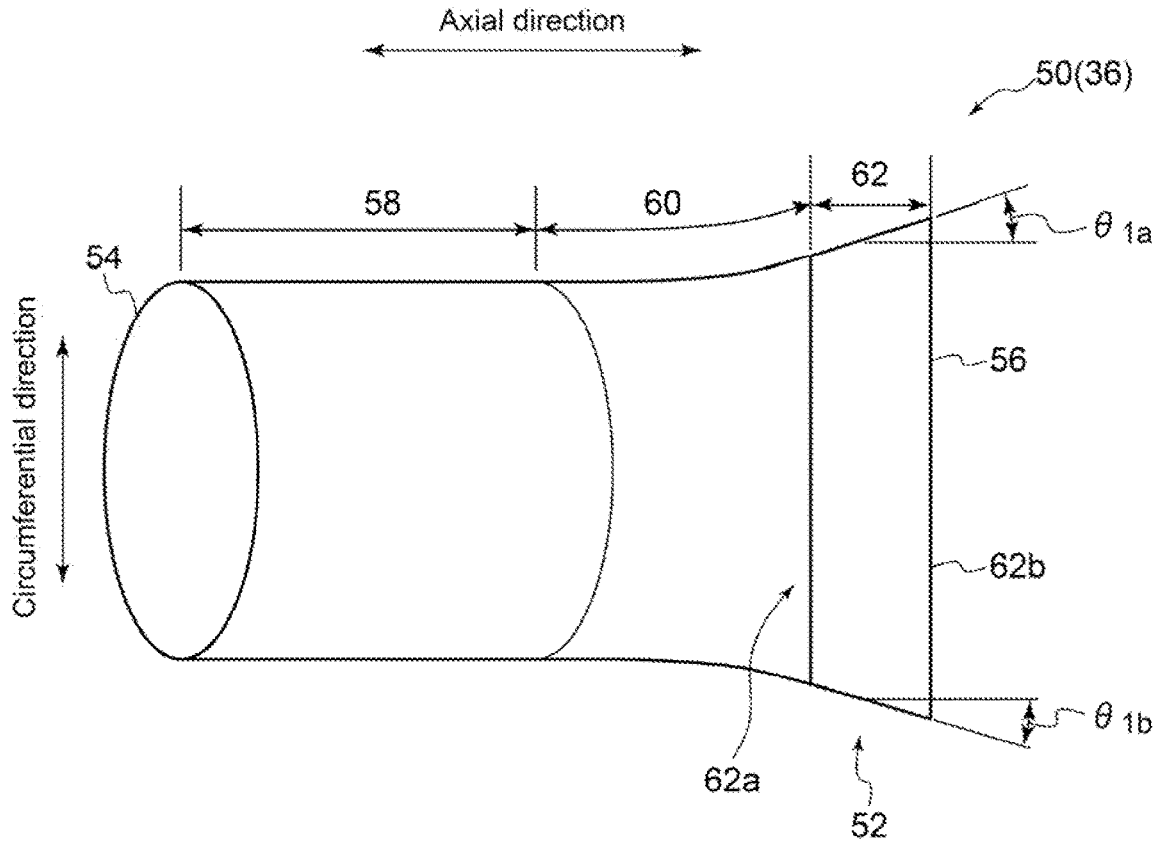
FIG. 3 is a schematic planar view of the combustion tube according to an embodiment.
Figure 4:
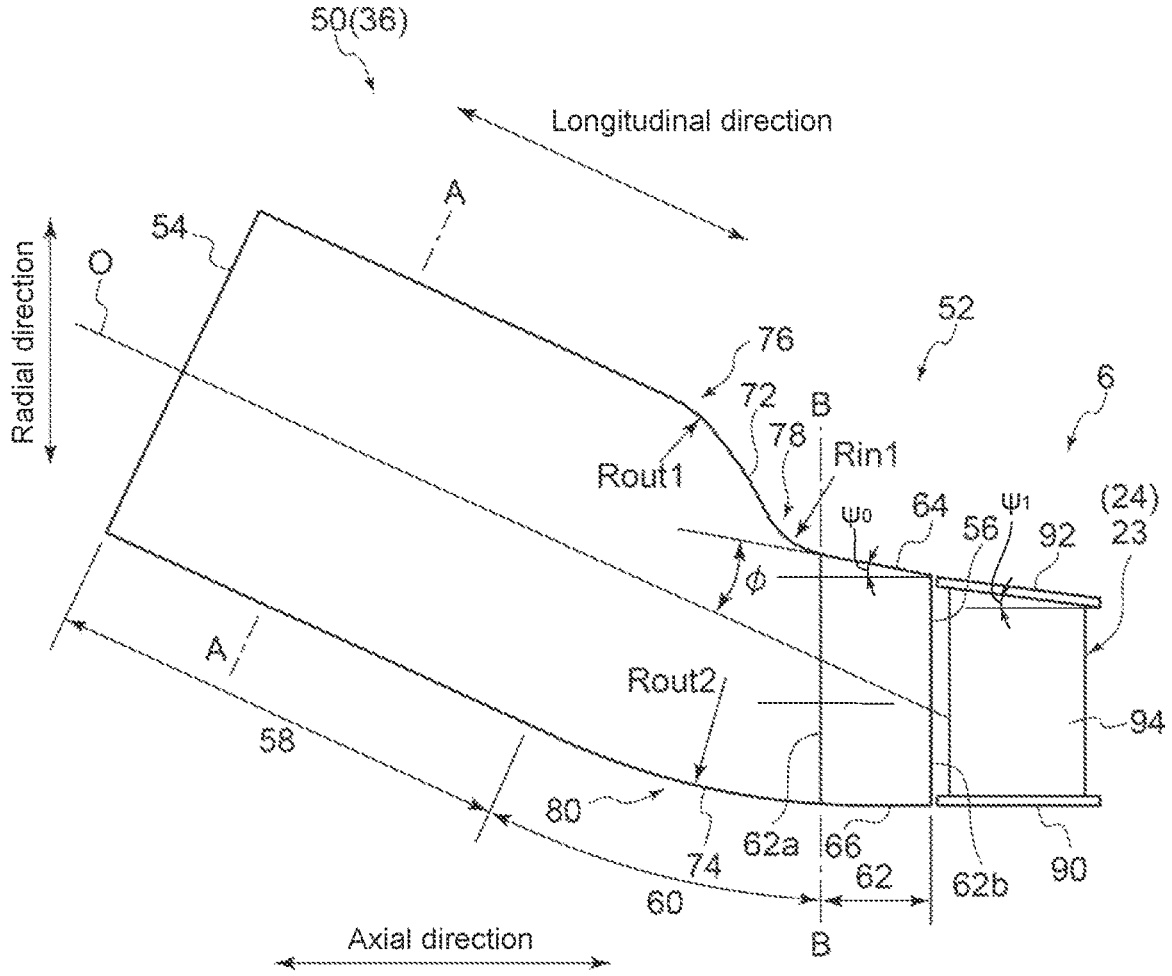
FIG. 4 is a schematic cross-sectional view taken along the axial direction of the combustion tube shown in FIG. 3.
Figure 5:
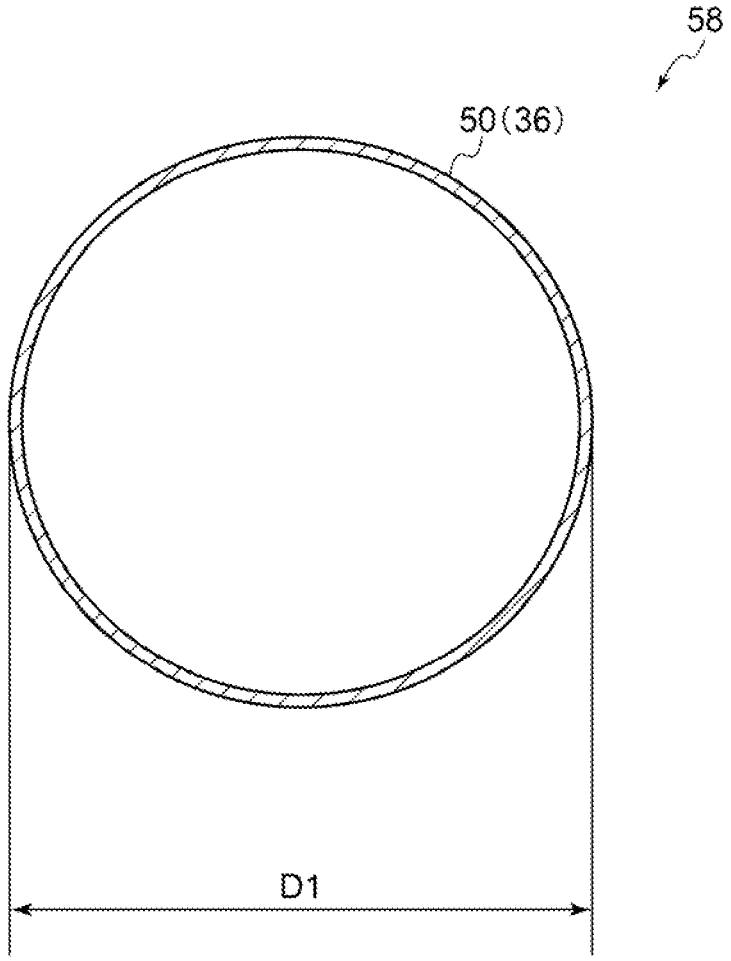
FIG. 5 is a cross-sectional view taken along line A-A in FIG. 4.
Figure 6:
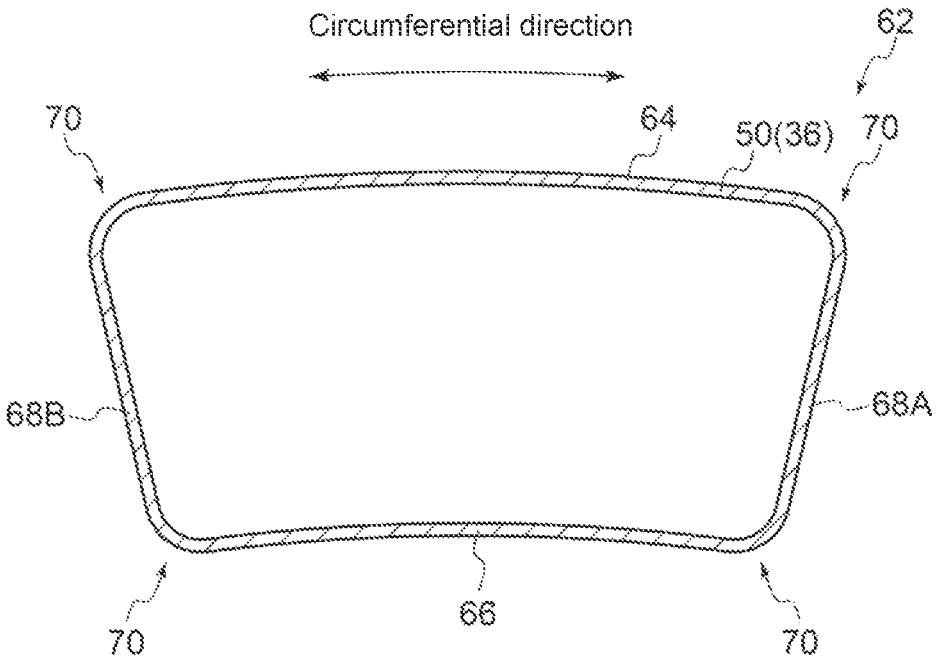
FIG. 6 is a cross-sectional view taken along line B-B in FIG. 4.

FIG. 3 is a schematic planar view (a view as seen radially inward in the gas turbine 1) of the transition piece 50 (combustion tube 36) according to an embodiment. FIG. 4 is a schematic cross-sectional view along the axial direction of the transition piece 50 (combustion tube 36) shown in FIG. 3. In addition, FIG. 5 is a cross-sectional view taken along line A-A in FIG. 4, and FIG. 6 is a cross-sectional view taken along line B-B in FIG. 4.

In FIG. 4, line A-A is a line orthogonal to a center line O of an inlet section 58, and line B-B is a line orthogonal to the axial direction of the gas turbine 1.

As shown in FIGS. 3 and 4, the transition piece 50 (combustion tube 36) according to an embodiment includes the inlet section 58 forming an inlet opening 54 of the transition piece 50 (combustion tube 36), an outlet section 62 forming an outlet opening 56 of the transition piece 50 (combustion tube 36) in the outlet part 52 of the combustor 4, and an intermediate section 60 positioned between the inlet section 58 and the outlet section 62.

In the combustor 4, the high-temperature combustion gas generated by combusting a fuel flows into the transition piece 50 (combustion tube 36) via the inlet opening 54, passes through the inlet section 58, the intermediate section 60, and the outlet section 62 in this order, and flows into the first-stage stator vane 23 (turbine 6; see FIGS. 1 and 2) from the combustor 4 via the outlet opening 56.

As shown in FIG. 5, the inlet section 58 constitutes a cylindrical portion of the transition piece 50 (combustion tube 36) and has a circular cross-section. The inlet section 58 may have a cylindrical shape or a truncated cone shape.

The inlet section 58 has a circular cross-section with a diameter DI which may substantially be constant over an entire region of an extending range of the inlet section 58 in the direction of the center line O of the inlet section 58 or may gradually decrease from the inlet opening 54 toward downstream.

As shown in FIGS. 3 and 4, the outlet section 62 is positioned most upstream in the axial direction, and has an upstream end 62*a* connected to the intermediate section 60 and a downstream end 62*b* where the outlet opening 56 is formed.

Moreover, as shown in FIG. 6, the outlet section 62 includes, in a cross-section shown in FIG. 6, an outer wall 64 and an inner wall 66 extending in the circumferential direction, and a first side wall 68A and a second side wall 68B which are a pair of side walls extending in the radial direction at respective both ends of the outer wall 64 and the inner wall 66. The inner wall 66 is positioned on the radially inward of the outer wall 64.

In some embodiments, the outer wall 64 and the inner wall 66, and the first side wall 68A and the second side wall 68B may smoothly be connected via curved corners 70, respectively.

As shown in FIG. 6, the cross-section of the outlet section 62 has an annular sector-shape formed by the outer wall 64, the inner wall 66, and the first side wall 68A and the second side wall 68B.

The outer wall 64 and the inner wall 66 form an outer peripheral boundary and an inner peripheral boundary of the annular sector-shape, respectively. The first side wall 68A and the second side wall 68B form boundaries on both sides of the annular sector-shape in the circumferential direction, respectively.

As shown in FIG. 6, the cross-sectional shape of the outlet section 62 can be regarded as having an annular sector-shape as a whole, even if the outer wall 64 and the inner wall 66, and the first side wall 68A and the second side wall 68B are smoothly connected via the curved corners 70.

More specific features of the outlet section 62 will be described later.

As shown in FIG. 4, the intermediate section 60 includes a first wall portion 72 connected to the outer wall 64 of the outlet section 62 and a second wall portion 74 connected to the inner wall 66 of the outlet section 62. Moreover, the intermediate section 60 has a cross-section whose shape changes from the circular cross-section of the intermediate section 58 to the annular sector cross-section of the outlet section 62 along the longitudinal direction of the transition piece 50 (combustion tube 36).

The inlet section 58 and the intermediate section 60, or the intermediate section 60 and the outlet section 62 may integrally be formed. Alternatively, the inlet section 58 and the intermediate section 60, or the intermediate section 60 and the outlet section 62 may be connected after each of the intermediate section 60 and the outlet section 62 is formed as a separate component.

If the outlet section 62 and the intermediate section 60 are manufactured as the separate components, it is possible to select shapes or manufacturing methods of the outlet section 62 and the intermediate section 60 more flexibly.

In an embodiment, at least one of the inlet section 58 or the intermediate section 60 is a component molded by sheet-metal working.

Further, in an embodiment, the outlet section 62 is a cast component molded by casting (for example, precision casting).

The outlet section 62 of the transition piece 50 (combustion tube 36) constituting the outlet part 52 of the combustor 4 may be required to have a complicated structure in order to, for example, be connected to the inlet part of the turbine 6. In this regard, forming the outlet section 62 by casting facilitates manufacture of the outlet section 62 even if the outlet section 62 has a relatively complicated structure.

If the intermediate section 60 and the outlet section 62 are manufactured as the separate components, the outlet section 62 and the intermediate section 60 may be joined by welding.

As shown in FIG. 4, the first-stage stator vane 23 disposed downstream of the transition piece 50 (combustion tube 36) of the combustor 4 includes an inner shroud 90 and an outer shroud 92 disposed on the radially outward of the inner shroud 90, and an airfoil portion 94 radially extending between the inner shroud 90 and the outer shroud 92.

Although not illustrated in particular, the outer shroud 92 is supported by the turbine casing 22 (see FIG. 1), and the first-stage stator vane 23 is supported by the turbine casing 22 via the outer shroud 92.

The features of the transition piece 50 (combustion tube 36) including the outlet section 62 will be described below in more detail.

Figure 7:
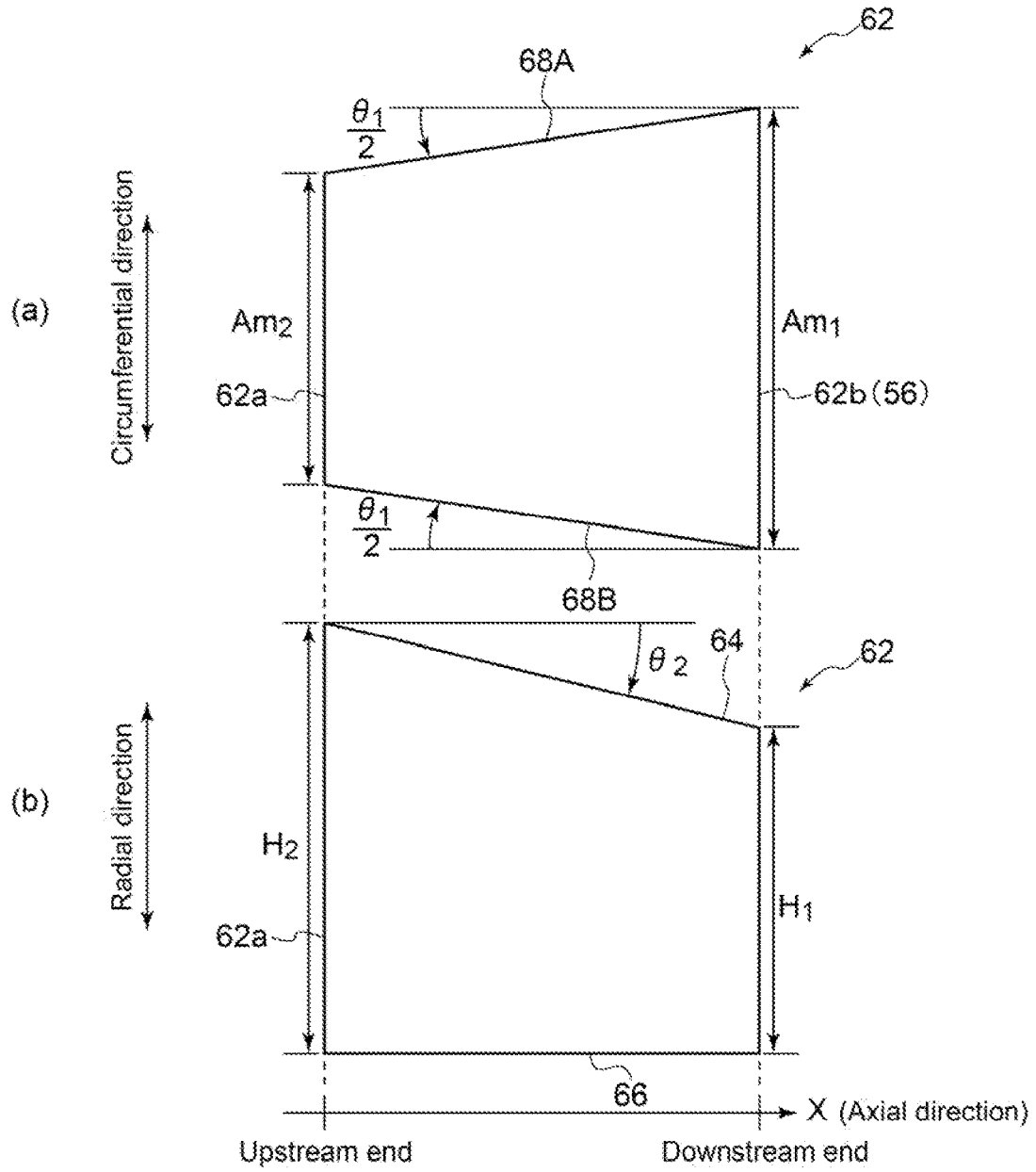
FIG. 7 shows views of a cross-sectional shape of an outlet section of a transition piece (combustion tube) according to an embodiment.
Figure 8:
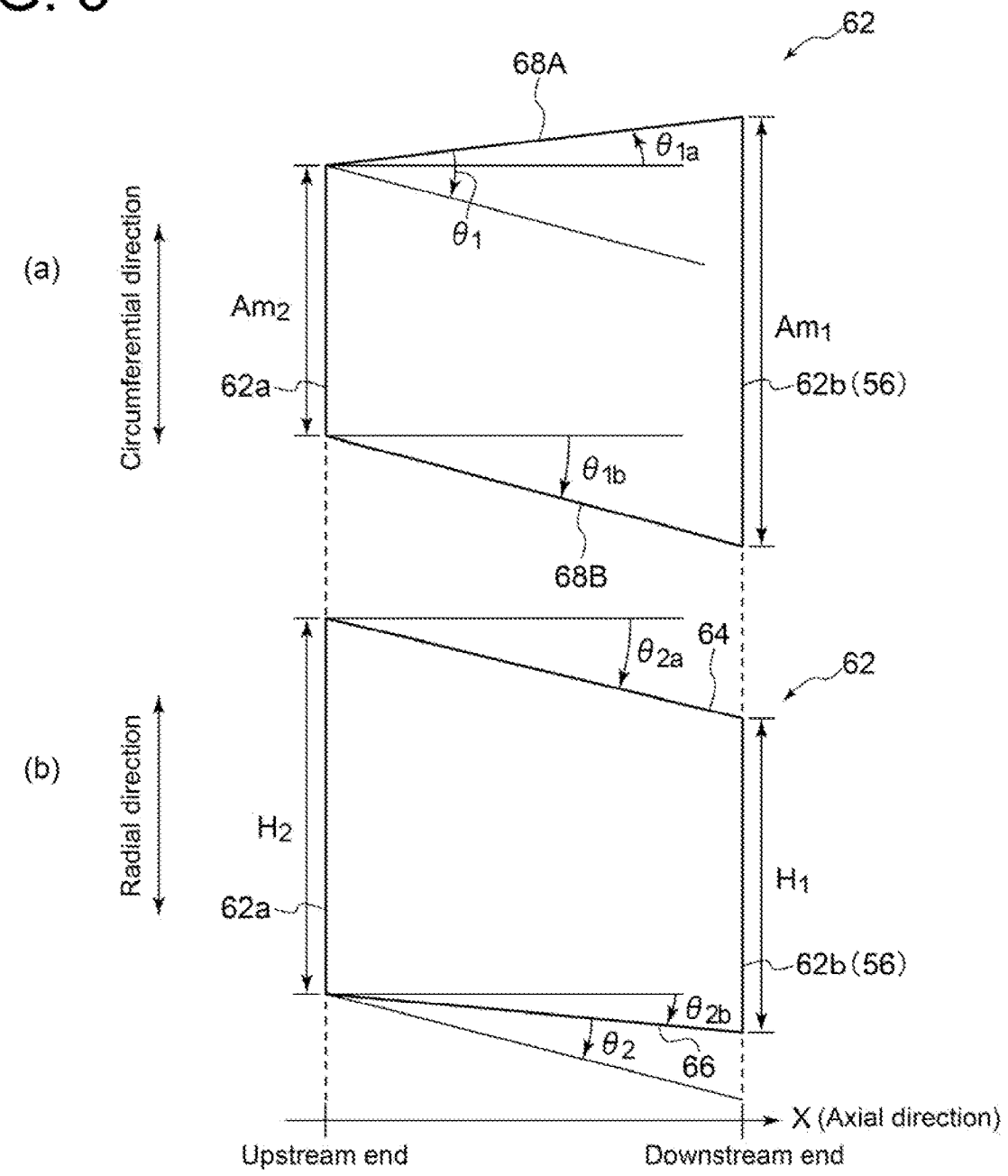
FIG. 8 shows views of a cross-sectional shape of an outlet section of a transition piece (combustion tube) according to an embodiment.

FIGS. 7 and 8 each show views of the cross-sectional shape of the outlet section 62 of the transition piece 50 according to an embodiment. (a) of FIG. 7 and (a) of FIG. 8 are each a cross-sectional view in a plane including the circumferential direction and the axial direction of the gas turbine 1. (b) of FIG. 7 and (b) of FIG. 8 are each a cross-sectional view in a plane including the radial direction and the axial direction of the gas turbine 1. In FIGS. 7 and 8, the axial direction of the gas turbine 1 is referred to as the x-axis.

Figure 9:
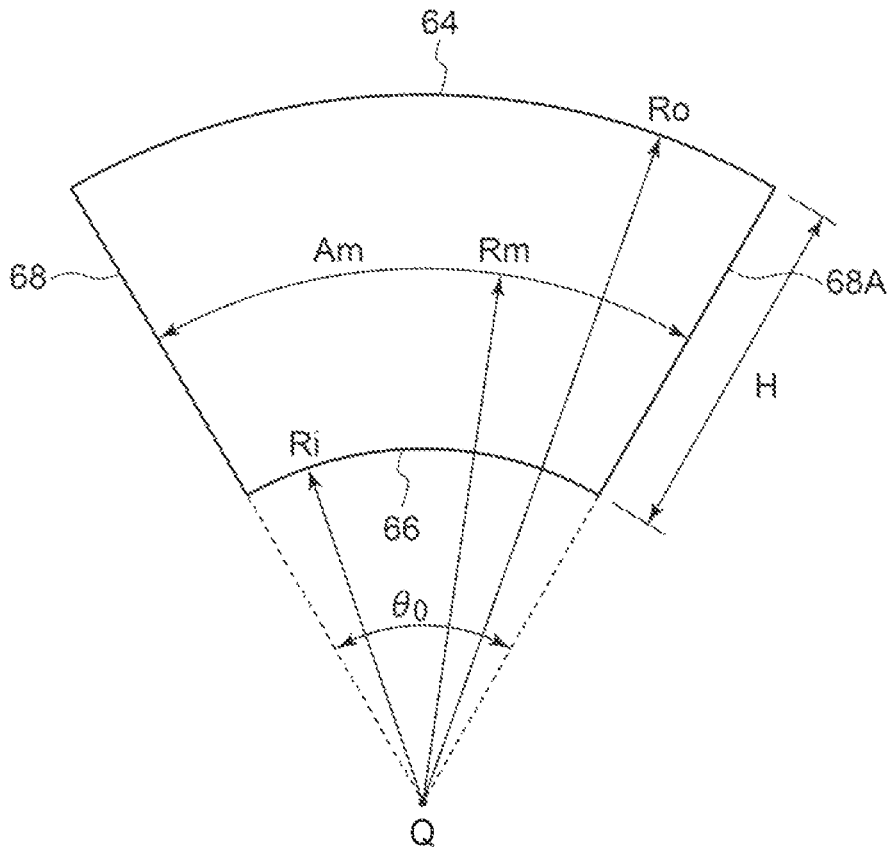
FIG. 9 is a schematic view showing a cross-section of an annular sector-shape of the outlet section.

Further, FIG. 9 is a schematic view showing a cross-section of the annular sector-shape of the outlet section 62. As shown in FIG. 9, provided that Ri is an inner diameter of the annular sector-shape, Ro is an outer diameter, and $\theta_0$ is a center angle around a center line (or rotational axis) Q of the gas turbine 1, a height H of the annular sector-shape is $(R_o-R_i)$, an average diameter Rm is $(R_o+R_i)/2$, and an average perimeter Am which is a perimeter in the average diameter is $Rm\times\theta_0$. Moreover, at this time, an area S of the annular sector-shape is $\pi(R_o^2-R_i^2)\times\theta_0/2\pi=Am\times H$ (that is, the average perimeter Am×the height H of the annular sector-shape).

Then, in FIGS. 7 and 8, $H_1$ and $H_2$ are respectively heights of the annular sector-shape at the downstream end 62*b* and the upstream end 62*a* of the outlet section 62, and $Am_1$ and $Am_2$ are respectively average perimeters of the annular sector-shape at the downstream end 62*b* and the upstream end 62*a* of the outlet section 62.

In some embodiments, the outlet section 62 has the following features (i) to (iii).

(i) First, in the outlet section 62, the outer wall 64 extends obliquely with respect to the inner wall 66 such that the height H of the annular sector-shape decreases toward the outlet opening 56 of the transition piece 50 (combustion tube 36).

That is, $\theta_2>0$ holds, where the heights $H_1$ and $H_2$ of the annular sector-shape at the downstream end 62*b* and the upstream end 62*a* of the outlet section 62 satisfy $H_1<H_2$, and $\theta_2$ [deg] is an inclination angle of the outer wall 64 with respect to the inner wall 66 ($\theta_2$ sets, as positive, a side where a cross-sectional area in the cross-section including the circumferential direction and the axial direction is reduced).

In (b) of FIG. 7, the inner wall 66 extends in the axial direction of the gas turbine 1, and thus the inclination angle $\theta_2$ of the outer wall 64 with respect to the inner wall 66 is as shown in (b) of FIG. 7.

On the other hand, in (b) of FIG. 8, the inner wall 66 is oblique by $\theta_{2b}$ with respect to the axial direction, the outer wall 64 is oblique by $\theta_{2a}$ with respect to the axial direction, and the inclination angle $\theta_2$ of the outer wall 64 with respect to the inner wall 66 is $\theta_2=\theta_{2a}-\theta_{2b}$.

(ii) Moreover, in the outlet section 62, the first side wall 68A of the first side wall 68A and the second side wall 68B which are a pair of side walls extends obliquely with respect to the second side wall 68B such that the perimeter of the annular sector-shape increases toward the outlet opening 56 of the transition piece 50 (combustion tube 36). It can be considered that "the perimeter of the annular sector-shape increases" corresponds to "the average perimeter Am of the annular sector-shape increases".

That is, $\theta_1>0$ holds, where the average perimeters $Am_1$ and $Am_2$ of the annular sector-shape at the downstream end 62*b* and the upstream end 62*a* of the outlet section 62 satisfy $Am_1>Am_2$, and $\theta_1$ [deg] is an inclination angle of the first side wall 68A with respect to the second side wall 68B ($\theta_1$ sets, as positive, a side where a cross-sectional area in the cross-section including the radial direction and the axial direction is increased).

In (a) of FIG. 7, the first side wall 68A and the second side wall 68B are oblique by the same measure of $\theta_1/2$ with respect to the axial direction (x-axis direction), and the inclination angle $\theta_1$ of the first side wall 68A with respect to the second side wall 68B is $2\times\theta_1/2$ On the other hand, in (a) of FIG. 8, the first side wall 68A is oblique by $\theta_{1a}$ with respect to the axial direction, the second side wall 68B is oblique by $\theta_{1b}$ with respect to the axial direction, and the inclination angle $\theta_1$ of the first side wall 68A with respect to the second side wall 68B is $\theta_1=\theta_{1a}+\theta_{1b}$.

(iii) Then, the above-described inclination angle $\theta_1$ [deg] satisfies $0<\theta_1<56$.

As a result of intensive researches by the present inventors, it was found that flow separation in the combustion tube can be suppressed through appropriate distribution of the flow path cross-sectional area in the outlet part 52 including the outlet section 62 of the transition piece 50 (combustion tube 36) by thus setting the inclination angle $\theta_1$ of the first side wall 68A with respect to the second side wall 68B greater than zero and not greater than 56 degrees. Therefore, it is possible to reduce the pressure loss in the gas turbine 1 by setting the above-described inclination angle $\theta_1$ not greater than 56 degrees.

In some embodiments, in addition to the above-described features (i) to (iii), in the outlet section 62, the inclination angle $\theta_2$ [deg] of the outer wall 64 with respect to the inner wall 66 satisfies $11\leq\theta_2\leq25$.

In this case, setting the above-described inclination angle $\theta_2$ [deg] within the range of $11\leq\theta_2\leq25$ in combination with the above-described inclination angle $\theta_1$ set greater than zero and not greater than 56 degrees, it is possible to further suppress the flow separation in the combustion tube 36. Thus, it is possible to effectively reduce the pressure loss in the gas turbine 1.

Moreover, in some embodiments, in addition to the above-described features (i) to (iii), in the outlet section 62, the inclination angle $\theta_1$ of the first side wall 68 with respect to the second side wall 68B satisfies $12\leq\theta_1\leq56$.

In this case, setting the above-described inclination angle $\theta_1$ not less than 12 degrees, it is possible to reduce the length of the combustion tube 36 needed to increase the perimeter (or the average perimeter Am) of the annular sector-shape in the outlet section 62 to the perimeter (or the average perimeter $Am_1$) of the outlet opening 56 and to reduce the size of the combustion tube 36.

In some embodiments, the inclination angle $\theta_1$ of the first side wall 68 with respect to the second side wall 68B may satisfy $0<\theta_1\leq 40$.

Further, in some embodiments, the above-described inclination angle $\theta_1$ may satisfy $0<\theta_1\leq 30$.

Thus setting an upper limit value of the above-described inclination angle $\theta_1$ at 40 degrees or not greater than 30 degrees in combination with the above-described inclination angle $\theta_1$ set not greater than 56 degrees, it is possible to further suppress the flow separation in the combustion tube.

In some embodiments, in addition to the above-described features (i) and (ii), the outlet section 62 has a feature (iv) to be described below.

$$|\theta_1|<|\theta_2|\times(Am_1/H_1) \quad \text{(iv)}$$

is satisfied, where $\theta_1$ [deg] is the inclination angle of the first side wall 68A with respect to the second side wall 68B in the outlet section 62, $\theta_2$ [deg] is the inclination angle of the outer wall 64 with respect to the inner wall 66, $H_1$ is the height of the annular sector-shape at the downstream end 62*b* of the outlet section 62, and $Am_1$ is the average perimeter of the outer wall 64 and the inner wall 66 (see FIGS. 7 and 8).

According to findings of the present inventors, in order for the flow path cross-sectional area of the outlet section 62 to gradually decrease downward, the above-described inclination angles $\theta_1$ and $\theta_2$, the height $H_1$ of the annular sector-shape at the downstream end 62*b* of the outlet section 62, and the average perimeter $Am_1$ of the outer wall 64 and the inner wall 66 of the annular sector-shape need to satisfy $|\theta_1|<|\theta_2|\times(Am_1/H_1)$.

In this regard, in the above-described embodiment, since the above-described $\theta_1$, $\theta_2$, $H_1$, and $Am_1$ satisfy $|\theta_1|<|\theta_2|\times(Am_1/H_1)$, the flow path cross-sectional area in the outlet part including the outlet section 62 of the transition piece 50 (combustion tube 36) decreases downward. Thus, it is possible to suppress the flow separation in the combustion tube 36 and to effectively reduce the pressure loss in the gas turbine 1.

Derivation of the above-described relational expression $|\theta_1|<|\theta_2|\times(Am_1/H_1)$ will now be described.

Figure 10:
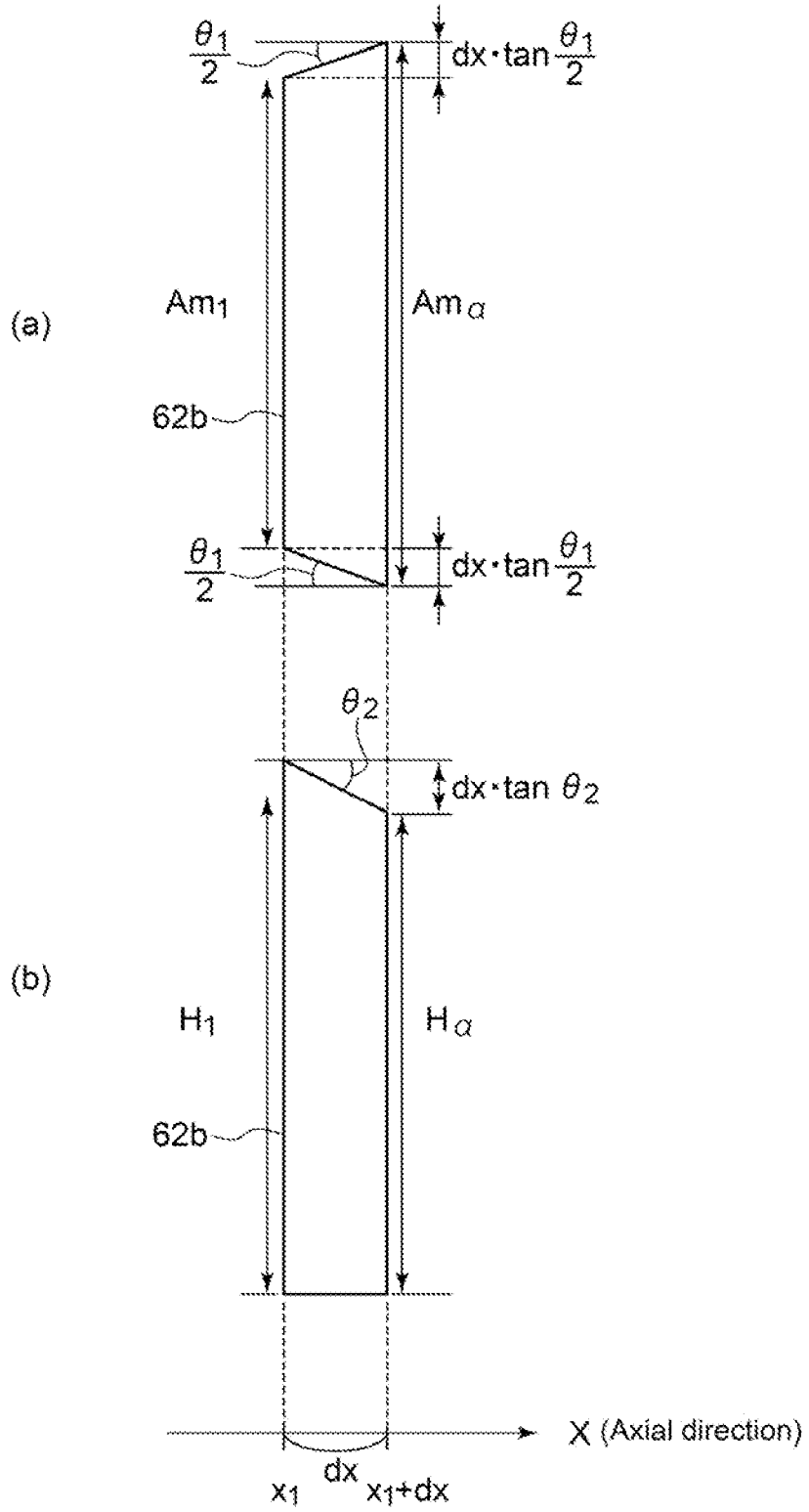
FIG. 10 shows views for describing minimal changes in flow path cross-sectional area of the outlet section having the shape shown in FIG. 7.

FIG. 10 shows views for describing minimal changes in the axial direction (x-axis direction) in the flow path cross-sectional area at the downstream end 62*b* of the outlet section 62 having the shape shown in FIG. 7.

(a) of FIG. 10 shows the minimal change in the shape of the outlet section 62 in the cross-section shown in (a) of FIG. 7, and (b) of FIG. 10 shows the minimal change in the shape of the outlet section 62 in the cross-section shown in (b) of FIG. 7.

Provided that $x_1$ is an axial position of the downstream end 62*b*, and $(x_1+dx)$ is an axial position obtained by changing the axial position $x_1$ by dx in the axial direction, at this time, a flow path cross-sectional area $S_1$ of the outlet section 62 at the downstream end 62*b* can be represented by:

$$S_1=Am_1\times H_1 \quad \text{(A)}$$

Moreover, provided that $Am_u$ is an average perimeter at the axial position $(x_i+dx)$, and $H_u$ is a height at the axial position $(x_1+dx)$, $Am_u=Am_1+dx\cdot 2\tan(\theta_1/2)$ and $H_u=H_1-dx\cdot\tan\theta_2$ hold with reference to (a) and (b) of FIG. 10. Thus, a flow path cross-sectional area $S_u$ at the axial position $(x_1+dx)$ can be represented by:

$$S_\alpha = AM_\alpha\times H_\alpha = \{Am_1 + dx\cdot 2\tan(\theta_1/2)\}\times\{H_1 - dx\cdot\tan\theta_2\} \quad \text{(B)}$$

In order for the flow path cross-sectional area $S_1$ to decrease downward in the axial direction, $$(ds/dx)<0 \quad \text{(C)}$$

is needed. Since $ds=S_u-S_1$ holds, deforming expression (C) by using expressions (A) and (B), $$(ds/dx) = \lim(x\to 0)\{(S_\alpha - S_1)/dx\} = -Am_1\cdot\tan\theta_2 + H_1\cdot 2\tan(\theta_1/2) < 0 \quad \text{(D)}$$

is obtained. Further rearranging equation (D), $$2\tan(\theta_1/2)<(Am_1/H_1)\cdot\tan\theta_2 \quad \text{(E)}$$

is obtained.

Provided that $\theta_1$ and $\theta_2$ are small enough to be approximated to $\tan(\theta_1/2)\approx(\theta_1/2)$, $\tan\theta_2\approx\theta_2$, $$|\theta_1|<|\theta_2|\times(Am_1/H_1) \quad \text{(F)}$$

is obtained from expression (E). Provided that $0°<\theta_1<90°$, $0°<\theta_2<90°$ hold, the above-described relational expression $$|\theta_1|<|\theta_2|\times(Am_1/H_1) \quad \text{(G)}$$

is derived.

The above-described relational expression (G) is derived here on the premise of the outlet section 62 having the shape shown in FIG. 7. However, it is possible to calculate the above-described relational expression (G) in the same manner, even if the outlet section 62 has the shape shown in FIG. 8.

In some embodiments, for example, as shown in FIG. 4, the outer wall 64 of the outlet section 62 extends obliquely with respect to the center line O of the inlet section 58 such that a distance between the outer wall 64 and the center line O increases toward the outlet opening 56 of the transition piece 50 (combustion tube 36).

That is, as shown in FIG. 4, an angle φ between the center line O of the inlet section 58 and the outer wall 64 of the outlet section 62 (the center of the angle φ is positioned upstream of the outlet opening 56 in the axial direction) is greater than zero and less than 90 degrees.

In this case, it is possible to suppress the pressure loss by smoothly connecting the outer wall 64 of the outlet section 62 in the transition piece 50 (combustion tube 36) and the outer shroud 92 of the first-stage stator vane 23 while setting the inclination angle of the center line O of the inlet section 58 in the transition piece 50 (combustion tube 36) with respect to the axial direction of the gas turbine 1 large to reduce the size of the combustion tube 36 in the axial direction.

In some embodiments, as shown in FIG. 4, the first wall portion 72 of the intermediate section 60 connected to the outer wall 64 of the outlet section 62 includes a first curved convex portion 76 and a curved concave portion 78 which are curved in the cross-section (that is, the cross-section shown in FIG. 4) along the longitudinal direction of the combustion tube 36. Moreover, the second wall portion 74 of the intermediate section 60 connected to the inner wall 66 of the outlet section 62 includes a second curved convex portion 80 which is curved in the cross-section along the longitudinal direction of the combustion tube 36.

The first curved convex portion 76 has the curvature center on the side of an interior space of the transition piece 50 (combustion tube 36) in the cross-section along the longitudinal direction of the combustion tube 36, and has a curvature radius of $R_{out1}$.

The curved concave portion 78 is positioned downstream of the first curved convex portion 76 in the cross-section along the longitudinal direction of the combustion tube 36. Moreover, the curved concave portion 78 has the curvature center on a side opposite to the interior space of the transition piece 50 (combustion tube 36) across the first wall portion 72, and has a curvature radius of $R_{in1}$.

The second curved convex portion 80 has the curvature center on the side of the interior space of the transition piece 50 (combustion tube 36) in the cross-section along the longitudinal direction of the combustion tube 36, and has a curvature radius of $R_{out2}$.

Then, the curvature radius $R_{out1}$ of the first curved convex portion 76, the curvature radius $R_{in1}$ of the curved concave portion 78, and the curvature radius $R_{out2}$ of the curvature radius of the second curved convex portion 80 satisfy $R_{out1}<R_{in1}<R_{out2}$.

The cross-sectional shape of the combustion tube 36 is rapidly changed from the cylindrical shape of the inlet section 58 toward the annular sector-shape of the outlet section 62 by setting the curvature radius $R_{out1}$ smallest among the curvature radii $R_{out1}$, $R_{in1}$, and $R_{out2}$ as described above, making it possible to reduce the length of the intermediate section 60. Moreover, the curvature of the curved concave portion 78 of the first wall portion 72 in the intermediate section 60 is relatively decreased by setting $R_{out1}<R_{in1}$ as described above, making it possible to increase the inclination angle $\theta_2$ of the outer wall 64 in the outlet section 62 and to suppress the flow separation in the outlet section 62. Furthermore, the shape of the second wall portion 74 in the intermediate section 60 is changed slowly by setting the curvature radius $R_{out2}$ largest among the above-described three types of curvature radii, making it possible to suppress the pressure loss.

In some embodiments, an angle between the outer shroud 92 of the first-stage stator vane 23 and the outer wall 64 of the outlet section 62 in the transition piece 50 (combustion tube 36) is not greater than 7 degrees on the axial cross-section (that is, the cross-section shown in FIG. 4) of the gas turbine 1.

That is, $|\Psi_{01}-\Psi_0|<7$ holds, where, on the above-described axial cross-section, $\Psi_0$ [deg] is an angle between the axial straight line and the outer shroud 92 of the first-stage stator vane 23, and $\Psi_1$ [deg] is an angle between the axial straight line and the outer wall 64 of the outlet section 62 (see FIG. 4).

Since the angle between the outer shroud 92 of the first-stage stator vane 23 and the outer wall 64 of the outlet section 62 in the transition piece 50 (combustion tube 36) is not greater than 7 degrees on the axial cross-section as described above, the outer shroud 92 of the first-stage stator vane 23 forming the combustion gas passage in the inlet part of the turbine 6 and the outer wall 64 are likely to be connected smoothly. Thus, it is possible to suppress the flow separation in a connection part between the combustion tube 36 and the turbine 6, and to reduce the pressure loss in the gas turbine 1 more effectively.

Embodiments of the present invention were described in detail above, but the present invention is not limited thereto, and also includes an embodiment obtained by modifying the above-described embodiment and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "containing" or "having" one constitutional element is not an exclusive expression that excludes the presence of other constitutional elements.

REFERENCE SIGNS LIST

1 Gas turbine
2 Compressor
4 Combustor
6 Turbine
8 Rotor
10 Compressor casing
12 Air inlet
16 Stator vane
18 Rotor blade
20 Casing
22 Turbine casing
24 Stator vane
26 Rotor blade
28 Combustion gas passage
30 Exhaust chamber
32 Combustor casing
36 Combustion tube
38 First combustion burner
40 Second combustion burner
41 Casing inlet
42 Fuel port
44 Fuel port
48 Combustor basket
50 Transition piece
52 Outlet part
54 Inlet opening
56 Outlet opening
58 Inlet section
60 Intermediate section
62 Outlet section
**62*a*** Upstream end
**62*b*** Downstream end
64 Outer wall
66 Inner wall
68A First side wall
68B Second side wall
70 Corner
72 First wall portion
74 Second wall portion
76 First curved convex portion
78 curved concave portion
80 Second curved convex portion
90 Inner shroud
92 Outer shroud

94 Airfoil portion
Am Average perimeter
H Height
O Center line
Rin1 Curvature radius
Rm Average diameter
Rout1 Curvature radius
Rout2 Curvature radius
θ1 Inclination angle
θ2 Inclination angle
φ Angle

The invention claimed is:

1. A combustion tube for a gas turbine including an outlet section having a cross-section of an annular sector-shape, wherein the outlet section has a downstream end where an outlet opening of the combustion tube is formed in a downstream end part of the combustion tube, wherein the outlet section includes:

an outer wall forming an outer peripheral boundary of the annular sector-shape;

an inner wall forming an inner peripheral boundary of the annular sector-shape; and a pair of side walls forming boundaries on both sides of the annular sector-shape in a circumferential direction, respectively, wherein the outer wall extends obliquely with respect to the inner wall such that a height of the annular sector-shape decreases toward the outlet opening of the combustion tube, wherein a first side wall of the pair of side walls extends obliquely with respect to a second side wall of the pair of side walls such that a perimeter of the annular sector-shape increases toward the outlet opening of the combustion tube, and $$\text{wherein } |\theta_1|<|\theta_2|\times(Am_1/H_1)$$

is satisfied, where $\theta_1$ [deg] is an inclination angle of the first side wall with respect to the second side wall, $\theta_2$ [deg] is an inclination angle of the outer wall with respect to the inner wall, $H_1$ is the height of the annular sector-shape at the downstream end of the outlet section, and $Am_1$ is an average perimeter of the outer wall and the inner wall at the downstream end of the outlet section.

2. The combustion tube according to claim 1, wherein the inclination angle $\theta_1$ [deg] satisfies $0<\theta_1\leq 56$.

3. The combustion tube for the gas turbine according to claim 2, wherein an inclination angle $\theta_2$ [deg] of the outer wall with respect to the inner wall satisfies $11\leq\theta_2\leq 25$.

4. The combustion tube for the gas turbine according to claim 2, wherein the inclination angle $\theta_1$ satisfies $12\leq\theta_1\leq 56$.

5. The combustion tube for the gas turbine according to claim 2, wherein the inclination angle $\theta_1$ satisfies $0<\theta_1\leq 40$.

6. The combustion tube for the gas turbine according to claim 5, wherein the inclination angle $\theta_1$ satisfies $0<\theta_1\leq 30$.

* * * * *